US005170177A

United States Patent [19]

Stanley et al.

[11] Patent Number: 5,170,177

[45] Date of Patent: Dec. 8, 1992

[54] METHOD OF OPERATING AN INK JET TO ACHIEVE HIGH PRINT QUALITY AND HIGH PRINT RATE

[75] Inventors: Douglas M. Stanley; Joy Roy, both of Tigard; Susan C. Schoening, Portland, all of Oreg.; Jeffrey J. Anderson, Camas, Wash.

[73] Assignee: Tektronix, Inc., Wilsonville, Oreg.

[21] Appl. No.: 807,777

[22] Filed: Dec. 10, 1991

Related U.S. Application Data

[63] Continuation of Ser. No. 553,498, Jul. 16, 1990, abandoned, which is a continuation-in-part of Ser. No. 698,172, May 6, 1991, and Ser. No. 692,957, Apr. 26, 1991, which is a continuation of Ser. No. 461,860, Jan. 8, 1990, abandoned, said Ser. No. 698,172, is a continuation of Ser. No. 451,080, Dec. 15, 1989, abandoned.

[51] Int. Cl.[5] ..... B41J 2/045

[52] U.S. Cl. ..... 346/1.1; 346/140 R

[58] Field of Search ..... 346/1.1, 140 R

[56] References Cited

U.S. PATENT DOCUMENTS

| | | | |
|---|---|---|---|
| 4,161,670 | 7/1979 | Kern . | |
| 4,387,383 | 6/1983 | Sayko . | |
| 4,459,599 | 7/1984 | Ort . | |
| 4,468,680 | 8/1984 | Martner . | |
| 4,491,851 | 1/1985 | Mizuno et al. . | |
| 4,492,968 | 1/1985 | Lee . | |
| 4,503,444 | 3/1985 | Tackland . | |
| 4,513,299 | 4/1985 | Lee et al. . | |
| 4,523,200 | 6/1985 | Howkins . | |
| 4,525,728 | 6/1985 | Koto . | |
| 4,563,689 | 1/1986 | Murakami et al. | 346/1.1 |
| 4,639,735 | 1/1987 | Yamamoto et al. . | |
| 4,686,539 | 8/1987 | Schmidle et al. . | |
| 4,714,935 | 12/1987 | Yamamoto et al. | 346/140 R |
| 4,728,969 | 3/1988 | Lee . | |
| 4,730,197 | 3/1988 | Raman | 346/140 |

OTHER PUBLICATIONS

Article entitled "Full-Color Ink-Jet Printer" by Moriyama, et al., published by Canon, Inc.

Article entitled "Drop-On-Demand Ink Jet Printing at High Print Rates and High Resolution", by F. C. Lee (IBM Research Laboratory 1981).

U.S. patent application Ser. No. 07/430,213 to Roy, et al. entitled "Drop-On-Demand Ink Jet Print Head".

*Primary Examiner*—Joseph W. Hartary

*Attorney, Agent, or Firm*—John D. Winkelman; Alan K. Aldous

[57] ABSTRACT

A drop-on-demand ink jet has an ink chamber coupled to a source of ink, and an ink drop orifice with an outlet. An acoustic driver produces a pressure wave in the ink and causes the ink to pass outwardly through the ink drop orifice and outlet. The driver is driven with bipolar drive pulses having a refill pulse component and an eject pulse component of a polarity which is opposite to the refull pulse component. The refill and eject pulse components are separated by a wait period. The drive pulses may be adjusted to minimize their energy content at a frequency corresponding to the dominant acoustic resonance frequency of the ink jet. This will accelerate drop breakoff, optimize drop shape and minimize drop speed variations over the range of drop printing rates. The ink jet printer of the present invention may be used to print with a wide variety of inks, including phase change inks to achieve high print quality at high print rates.

11 Claims, 4 Drawing Sheets

METHOD OF OPERATING AN INK JET TO ACHIEVE HIGH PRINT QUALITY AND HIGH PRINT RATE

This is a continuation of application Ser. No. 07/553,498, filed Jul. 16, 1990, now abandoned, which is (1) a continuation-in-part of application Ser. No. 07/698,172, filed May 6, 1991, which is a continuation of application Ser. No. 07/451,080, filed Dec. 15, 1989, now abandoned, and (2) a continuation-in-part of application Ser. No. 07/692,957, filed Apr. 26, 1991, which is a continuation of application Ser. No. 07/461,860, filed Jan. 8, 1990, now abandoned.

BACKGROUND OF THE INVENTION

The present invention relates to printing with a drop-on-demand ink jet print head wherein ink drops are generated utilizing a drive pulse which is shaped to enhance the consistency of drop flight time from the ink jet print head to print media over a wide range of drop ejection rates.

Ink jet printers, and in particular drop-on-demand ink jet printers having print heads with acoustic drivers for ink drop formation are well known in the art. The principle behind an impulse ink jet of this type is the generation of a pressure wave in an ink chamber and subsequent emission of ink droplets from the ink chamber through a nozzle orifice as a result of the pressure wave. A wide variety of acoustic drivers are employed in ink jet print heads of this type. For example, the drivers may consist of a transducer formed by a piezoceramic material bonded to a thin diaphragm. In response to an applied voltage, the piezoelectric ceramic deforms and causes the diaphragm to displace ink in the ink chamber, which results in a pressure wave and the flow of ink through one or more nozzles. Piezoelectric drivers may be of any suitable shape such as circular, polygonal, cylindrical, annular-cylindrical, etc. In addition, piezoelectric drivers may be operated in various modes of deflection, such as in the bending mode, shear mode, and longitudinal mode. Other types of acoustic drivers for generating pressure waves in ink include heater-bubble source drivers (so called bubble or thermal ink jets) and electromagnet-solenoid drivers. In general, it is desirable in an ink jet print head to employ a geometry that permits multiple nozzles to be positioned in a densely packed array with each nozzle being driven by an associated acoustic driver.

U.S. Pat. No. 4,523,200 to Howkins describes one approach to operating an ink jet print head with the purpose of achieving high velocity ink drops free of satellites and orifice puddling and providing stabilized jet operation. In this approach, an electromechanical transducer is coupled to an ink chamber and is driven by a composite waveform including independent successive first and second electrical pulses of opposite polarity in some cases and separated by a time delay. The first electrical pulse is an eject pulse with a pulse width which is substantially greater than the second pulse width. The illustrated second pulse in the case where the pulses are of opposite polarity has an exponentially decaying trailing edge. The application of the first pulse causes a rapid volume reduction of the ink chamber of the ink jet head and initiates the ejection of an ink drop from the associate orifice. The application of the second pulse causes rapid volume expansion of the ink chamber and produces early break-off of an ink drop from the orifice. There is no suggestion in this reference of controlling the position of an ink meniscus before drop ejection and therefore problems in uniform printing at high drop repetition rates would be expected.

U.S. Pat. No. 4,563,689 to Murakami, et al. discloses an approach for operating an ink jet print head with the purpose of achieving different size drops on print media. In this approach, a preceding pulse is applied to an electromechanical transducer prior to a main pulse. The preceding pulse is described as a voltage pulse that is applied to a piezoelectric transducer in order to oscillate ink in the nozzle and the energy contained in the voltage pulse is below the threshold necessary to eject a drop. The preceding pulse controls the position of the ink meniscus in the nozzle and thereby the ink drop size. In FIGS. 4 and 8 of this patent, the preceding and main pulses are of the same polarity. In FIGS. 9 and 11, of this patent, these pulses are of opposite polarity. This patent also mentions that the typical delay time between the start of the preceding pulse to the start of the main pulse is on the order of 500 microseconds. Consequently, in this approach, drop ejection would be limited to relatively low repetition rates.

In addition, Murakami et al. is directed to controlling drop size and does not describe an ink jet that ejects drops with flight times substantially independent of the repetition rate. Moreover, there is no teaching or suggestion in Murakami et al. that a bipolar waveform with a wait period has a minimum energy content at the dominant acoustic resonant frequency of the ink jet.

Although these prior art devices are known, a need exists for an improved ink jet printer which is capable of effectively achieving uniform high quality printing, at high print rates.

SUMMARY OF THE INVENTION

A drop-on-demand ink jet is described of the type having an ink chamber coupled to a source of ink, an ink drop forming orifice with an outlet, and in which the ink drop orifice is coupled to the ink chamber. An acoustic driver is used to produce a pressure wave in the ink to cause the ink to pass outwardly through the ink drop orifice and the outlet. The driver is operated to expand and contract the ink chamber to eject a drop of ink from the ink drop ejecting orifice outlet with the volume of the ink chamber first being expanded to refill the chamber with ink from a source of ink. During this expansion, ink is also withdrawn within the orifice toward the ink chamber and away from the ink drop ejection orifice outlet. A wait period is then established during which time the ink chamber is returning back to its original volume and the ink in the orifice to advance within the orifice away from the ink chamber and toward the ink drop ejection orifice outlet. In addition, the driver is then operated to contract the volume of the ink chamber to eject a drop of ink. Thus, a sequence of ink chamber expansion, a wait period, and ink chamber contraction is followed during the ejection of ink drops.

In accordance with another aspect of the invention, these drop ejection steps are repeated, for example at a high rate to achieve rapid printing. In addition, each of the waiting steps comprises the step of waiting until the ink in the orifice advances to substantially the same position within the orifice to which the ink advances during the other waiting steps before the ink chamber is contracted to eject an ink drop.

As yet another aspect of the present invention, the waiting step comprises the step of waiting until the ink advances to a position substantially at the ink drop ejection orifice outlet, but not beyond such orifice outlet, before contracting the volume of the ink chamber to eject a drop of ink.

As still another aspect of the present invention, the contracting step occurs at a time when the ink is advancing toward that is, has a forward component of motion toward, the ink drop ejection orifice outlet.

As a still further aspect of the present invention, the driver may comprise a piezoelectric driver which is driven by a drive pulse including first and second pulse components separated by a wait period, the first and second pulse components being of an opposite polarity. These pulse components or electric drive pulses may be of a square wave or trapezoidal wave form.

In accordance with still another aspect of the present invention, the dominant acoustic resonance frequency of the ink jet may be determined in a known manner. Typically, the most significant factor affecting the acoustic resonance frequency of the ink jet is the length of ink passage from the outlet of the ink chamber to the orifice outlet of the ink jet. The energy content of the complete electric drive pulse at various frequencies is also determined. The complete electric drive pulse in this case includes the refill pulse components, the drive pulse components, and wait periods utilized in ejecting a drop of ink. A standard spectrum analyzer may be used to determine the energy content of the drive pulse at various frequencies. The drive pulse is then adjusted, preferably by adjusting the duration of the wait period and the first or refill pulse component, such that a minimum energy content of the drive pulse exists at the dominant acoustic resonance frequency of the ink jet. If an ink jet of the type having an offset channel between the ink chamber and the ink drop ejection orifice outlet is used, the dominant acoustic resonance frequency corresponds to the standing wave resonance frequency through liquid ink in the offset channel of the ink jet. With this approach, the drive signal is tuned to the characteristics of the ink jet to avoid high energy components at the dominant resonance frequency of the ink jet.

As yet another aspect of the present invention, the drive pulse may be adjusted, if necessary, such that the minimum energy content of the drive pulse at a frequency which substantially corresponds to the dominant acoustic frequency of the ink jet is at least about 20 db below the maximum energy content of the drive pulse at frequencies other than the frequency which substantially corresponds to the dominant acoustic resonance frequency. In addition, the drive pulse may be adjusted, such that the maximum energy content of the drive pulse does not occur at a frequency which is sufficiently close (for example, less than 10 KHz) to any of the major resonance frequencies of the ink jet print head. These major resonance frequencies include the meniscus resonance frequency, Helmholtz resonance frequency, piezoelectric drive resonance frequency and various acoustic resonance frequencies of the different channels and passageways forming the ink jet print head.

As a further aspect of the present invention, the drive pulse may have refill and ejection pulse components of a trapezoidal shape in which the pulse components have a different rate of rise to their maximum amplitude than the rate of fall from the maximum amplitude. More specifically, the first electric drive pulse or refill pulse component may have a rise time from about 1 to about 4 microseconds, be at a maximum amplitude for from about 2 to about 7 microseconds, and may have a fall time from about 1 to about 7 microseconds. In addition, the wait period may be greater than about 8 microseconds. Furthermore, the second electric drive or eject pulse component may be within the same range of rise time, time at a maximum amplitude and fall time as the first electric drive pulse, but of opposite polarity. More specifically, the rise time of the first and second electric drive pulse component may more preferably be from about 1 to about 2 microseconds, the first and second electric drive pulse component may be at its maximum amplitude for from about 4 to about 5 microseconds, and the first and second electric drive pulse may have a fall time of from about 2 to about 4 microseconds, with the wait period being from about 15 to about 22 microseconds.

The present invention relates to a method having the above aspects individually and in combination with one another.

It is accordingly one object of the present invention to provide an ink jet print head which is capable of reliably and efficiently printing media with ink, including hot melt ink.

Another object of the present invention is to provide an improved ink jet print head which is capable of producing ink drops requiring a substantially uniform travel time to reach print media over a wide range of drop repetition or ejection rates.

These and other objects, features and advantages of the present invention will become more apparent with reference to the following description and drawings.

BRIEF DESCRIPTION OF THE DRAWINGS

FIG. 4, and in particular

DETAILED DESCRIPTION OF THE PREFERRED EMBODIMENTS

Figure 1:
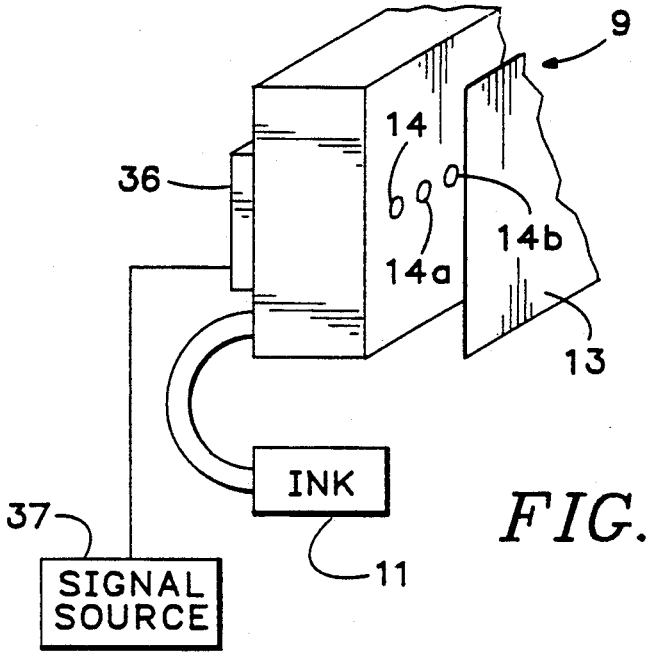
FIG. 1 is a schematic illustration of one form of an ink jet print head in accordance with the present invention with print media shown spaced from the ink jet print head.

With reference to FIG. 1, a drop-on-demand ink jet print head 9 is illustrated with an internal ink chamber (not shown in this figure) coupled to a source of ink 11. The ink jet print head 9 has one or more orifice outlets 14, 14*a*, 14*b*, etc. coupled to or in communication with the ink chamber by way of an ink orifice. Ink passes through the orifice outlets during ink drop formation. The ink drops travel in a first direction along a path from the orifice outlets toward print medium 13, which is spaced from the outlets. A typical ink jet printer includes a plurality of ink chambers each coupled to one or more of the respective orifices and orifice outlets.

An acoustic drive mechanism 36 is utilized for generating a pressure wave in the ink to cause ink to pass outwardly through the ink drop orifice and associated outlet. The driver 36 operates in response to signals from a signal source 37 to cause the desired pressure waves in the ink.

It should be noted that the invention has particular applicability and benefits when piezoelectric drivers are used in ink drop formation. One preferred form of an ink jet print head using this type of driver is described in detail in a patent application entitled "Drop-on-Demand Ink Jet Print Head", filed Nov. 1, 1989, U.S. Ser. No. 07/430,213, to Joy Roy and John Moore now U.S. Pat. No. 5,087,930. This particular patent application is incorporated herein by reference and is owned by the Assignee of the present application. However, it is also possible to use other forms of ink jet printers and acoustic drivers in conjunction with the present invention. For example, electromagnet-solenoid drivers, as well as other shapes of piezoelectric drivers (e.g., circular, polygonal, cylindrical, annular-cylindrical, etc.) may be used. In addition, various modes of deflection of piezoelectric drivers may also be used, such as bending mode, shear mode, and longitudinal mode.

Figure 3:
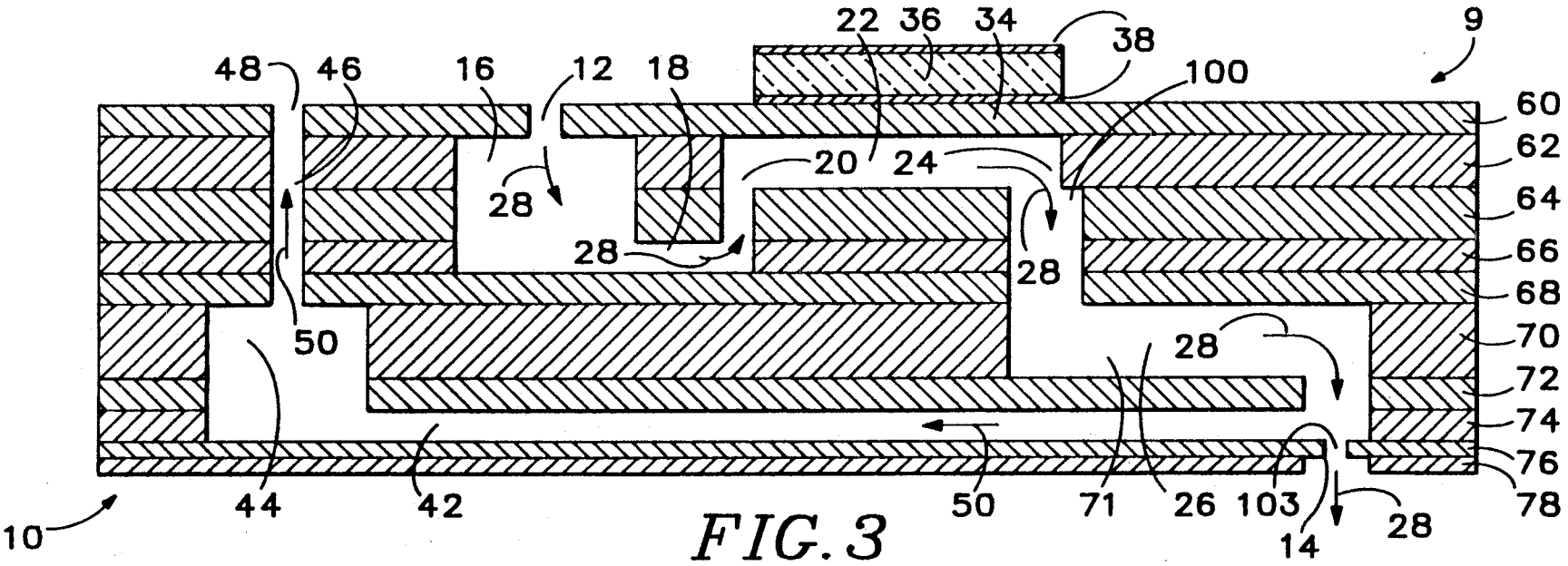
FIG. 3 is a schematic illustration, in section, of one type of ink jet print head which is capable of being operated in accordance with the method of the present invention.

With reference to FIG. 3, one form of ink jet print head 9 in accordance with the disclosure of the above-identified patent application Ser. No. 07/430,213 has a body 10 which defines an ink inlet 12 through which ink is delivered to the ink jet print head. The body also defines an ink drop forming orifice outlet or nozzle 14 together with an ink flow path from the ink inlet 12 to the nozzle. In general, the ink jet print head of this type would preferably include an array of nozzles 14 which are proximately disposed, that is closely spaced from one another, for use in printing drops of ink onto print medium.

Ink entering the ink inlet 12, e.g. from ink supply 11 as shown in FIG. 1, passes to a supply manifold 16. A typical color ink jet print head has at least four such manifolds for receiving, respectively, black, cyan, magenta, and yellow ink for use in black plus three color subtraction printing. However, the number of such manifolds may be varied depending upon whether a printer is designed to print solely in black ink or with less than a full range of color. From ink supply manifold 16, ink flows through an ink supply channel 18, through an ink inlet 20 and into an ink pressure chamber 22. Ink leaves the pressure chamber 22 by way of an ink pressure chamber outlet 24 and flows through an ink passage or orifice 26 to the nozzle 14 from which ink drops are ejected. Arrows 28 diagram this ink flow path.

The ink pressure chamber 22 is bounded on one side by a flexible diaphragm 34. The pressure transducer, in this case a piezoelectric ceramic disc 36 secured to the diaphragm 34, as by epoxy, overlays the ink pressure chamber 22. In a conventional manner, the piezoceramic disc 36 has metal film layers 38 to which an electronic circuit driver, not shown in FIG. 3, but indicated at 37 in FIG. 1, is electrically connected. Although other forms of pressure transducers may be used, the illustrated transducer is operated in its bending mode. That is, when a voltage is applied across the piezoelectric disc, the disc attempts to change its dimensions. However, because it is securely and rigidly attached to the diaphragm, bending occurs. This bending displaces ink in the ink chamber 22, causing the outward flow of ink through the passage 26 and to the nozzle. Refill of the ink chamber 22 following the ejection of an ink drop can be augmented by reverse bending of the transducer 36.

In addition to the main ink flow path 26 described above, an optional ink outlet or purging channel 42 is also defined by the ink chamber body 10. The purging channel 42 is coupled to the ink passage 26 at a location adjacent to, but interiorly of, the nozzle 14. The purging channel communicates from passage 26 to an outlet or purging manifold 44 which is connected by an outlet passage 46 to a purging outlet port 48. The manifold 44 is typically connected by similar purging channels 42 to the passages associated with multiple nozzles. During a purging operation, ink flows in a direction indicated by arrows 50, through purging channel 42, manifold 44, purging passage 46 and to the purging outlet port 48.

To facilitate manufacture of the ink jet print head of FIG. 3, the body 10 is preferably formed of plural laminated plates or sheets, such as of stainless steel. These sheets are stacked in a superposed relationship. In the illustrated FIG. 3 form of ink jet print head, these sheets or plates include a diaphragm plate 60, which forms the diaphragm and also defines the ink inlet 12 and purging outlet 48; an ink pressure chamber plate 62, which defines the ink pressure chamber 22, a portion of the ink supply manifold, and a portion of the purging passage 48; a separator plate 64, which defines a portion of the ink passage 26, bounds one side of the ink pressure chamber 22, defines the inlet 20 and outlet 24 to the ink pressure chamber, defines a portion of the ink supply manifold 16 and also defines a portion of the purging passage 46; an ink inlet plate 66, which defines a portion of the passage 26, the inlet channel 18, and a portion of the purging passage 46; another separator plate 68 which defines portions of the passages 26 and 46; an offset channel plate 70, which defines a major or offset portion 71 of the passage 26 and a portion of the purging manifold 44; a separator plate 72 which defines portions of the passage 26 and purging manifold 44; an outlet plate 74 which defines the purging channel 42 and a portion of the purging manifold; a nozzle plate 76 which defines the nozzles 14 of the array; and an optional guard plate 78 which reinforces the nozzle plate and minimizes the possibility of scratching or other damage to the nozzle plate.

More or fewer plates than illustrated may be used to define the various ink flow passageways, manifolds and pressure chambers. For example, multiple plates may be used to define an ink pressure chamber instead of a single plate as illustrated in FIG. 3. Also, not all of the various features need be in separate sheets or layers of metal.

Exemplary dimensions for elements of the ink jet of FIG. 3 are set forth in the table below.

TABLE 1

Representative Dimensions and Resonance Characteristics For Figure 3 Ink Jets

| Feature | Cross Section | Length | Frequency of Resonance |
|---|---|---|---|
| Ink Supply Channel 18 | 0.008" × 0.010" | 0.268" | 60-70 KHz |
| Diaphragm Plate 60 | 0.110" dia. | 0.004" | 160-180 KHz |
| Body Chamber 22 | 0.110" dia. | 0.018" | |
| Separator Plate 64 | 0.040" × 0.036" | 0.022" | |
| Off-Set Channel 71 | 0.020" × 0.036" | 0.116" | 65-85 KHz |
| Purging Channel 42 | 0.004" × 0.010" | 0.350" | 50-55 KHz |
| Orifice Outlet 14 | 50-70 μm | 60-76 μm | 13-18 KHz |

The various layers forming the ink jet print head may be aligned and bonded in any suitable manner, including by the use of suitable mechanical fasteners. However, one approach for bonding the metal layers is described in U.S. Pat. No. 4,883,219 to Anderson, et al., and entitled "Manufacture of Ink Jet Print Heads by Diffusion Bonding and Brazing."

Figure 2:
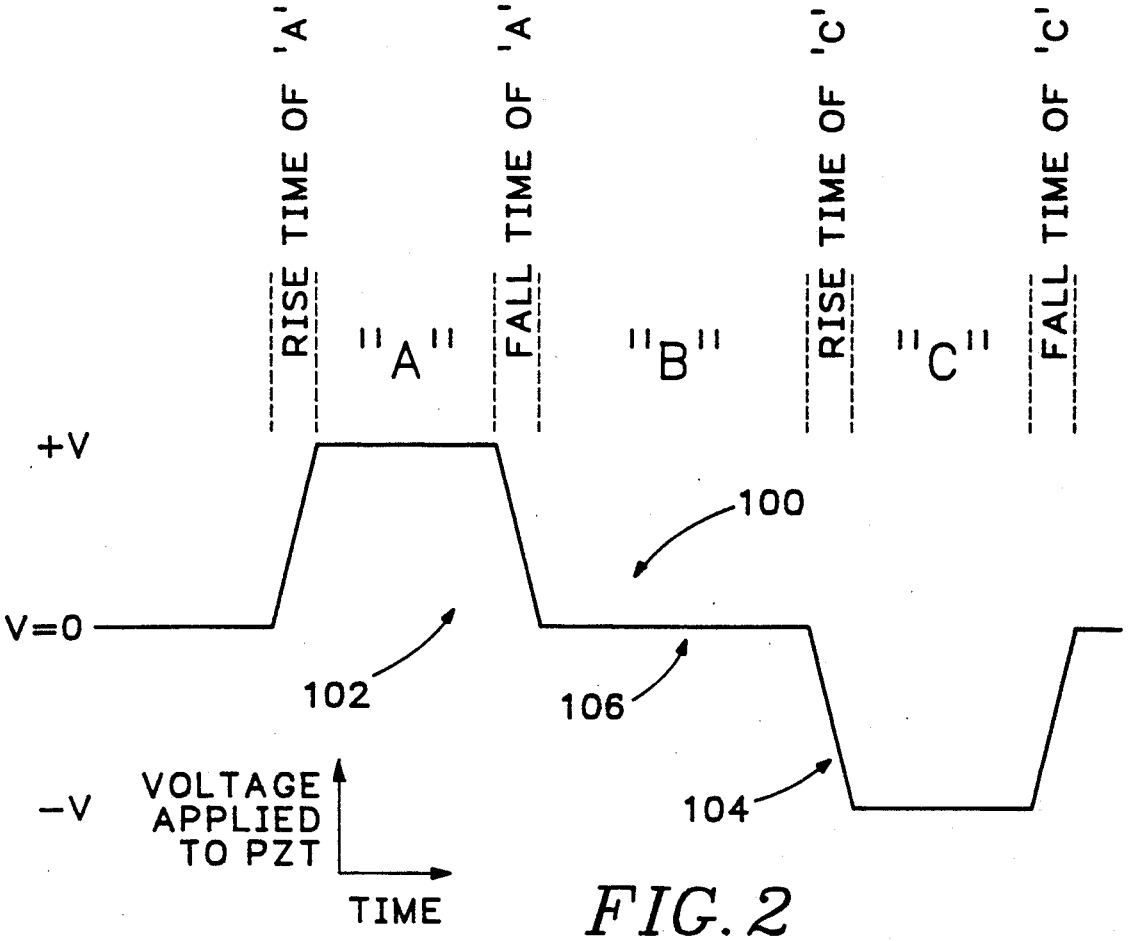
FIG. 2 illustrates a form of drive signal for an acoustic driver of an ink jet print head in accordance with the present invention.

In accordance with the present invention, an advantageous drive signal for driving ink jets utilizing acoustic drivers is illustrated in FIG. 2. This particular drive signal is a bipolar electric pulse 100 with a refill pulse component 102 and an ejection pulse component 104. The components 102 and 104 are voltages of opposite polarity of possibly different magnitudes. These electric pulses or pulse components 102, 104 are also separated by a wait time period indicated at 106. The duration of the wait time period 106 is indicated as "B" in FIG. 2. The polarities of the pulse components 102, 104 may be reversed from that shown in FIG. 2, depending upon the polarization of the piezoelectric driver mechanism 36 (FIG. 1).

In operation, upon the application of the refill pulse component 102, the ink chamber 22 expands and draws ink into the chamber for refilling the chamber following the ejection of a drop. As the voltage falls toward zero at the end of the refill pulse, the ink chamber begins to contract and moves the ink meniscus forwardly in the ink orifice 103 (FIG. 3) toward the orifice outlet 14. During the wait period "B", the ink meniscus continues toward the orifice outlet 14. Upon the application of the ejection pulse component 104, the ink chamber 22 is rapidly constricted to cause the ejection of a drop of ink. In this approach for forming a drop, the duration of the refill pulse component is less than the time required for the meniscus, which has been withdrawn further into the orifice 103 as a result of the refill pulse, to return to an initial position adjacent to the orifice outlet 14. Typically, the duration of the refill pulse component is less than one-half of the time period of the natural or resonance frequency of the meniscus. More preferably, this duration is less than about one-fifth of the time period of the meniscus' natural resonance frequency. The resonance frequency of an ink meniscus in an orifice of an ink jet can be easily calculated from the properties of the ink and the dimensions of the ink orifice in a known manner.

As the duration of the wait period "B" increases, the ink meniscus moves closer to the orifice outlet 14 at the time the ejection pulse component 104 is applied. In general, the duration of wait period and of the eject pulse component are less than about one-half of the time period of the natural or resonance frequency of the meniscus. Typical meniscus resonance time periods range from about 50 microseconds to about 160 microseconds, depending upon the configuration of the ink jet print head and the ink being used.

The pulse components 102 and 104 are shown in FIG. 2 as being generally trapezoidal and are of opposite polarity. Square wave pulse components may also be used. A conventional signal source 37 may be used to generate drive pulses of this shape. Other drive pulse shapes may also be used. In general, a suitable refill component drive pulse shape is one which results in expansion of the volume of the ink chamber 22 to refill the chamber with ink from the source of ink and to withdraw the ink in the orifice 103 toward the ink chamber 22 and away from the ink drop ejection orifice outlet 14. The wait period, a period during which essentially no drive signal is typically applied to the acoustic driver, comprises a period during which the ink chamber is allowed to return back toward its original volume so as to allow the ink meniscus in the orifice 103 to advance within the orifice away from the ink chamber and toward the ink drop ejection orifice outlet 14. The eject pulse component is of a shape which causes a rapid contraction of the volume of the ink chamber following the wait period to eject a drop of ink.

During continuous operation of an ink jet print head, pulses of the form shown in FIG. 2 are repeatedly applied to cause the ejection of ink drops. One or more such pulses may be applied to cause the formation of each drop, but at least one such composite pulse is preferably used to form each of the drops. In addition, the duration of the wait period is typically set for a time which allows the ink meniscus in the orifice 103 to advance to substantially the same position within the orifice during each wait period before contraction of the ink chamber to eject a drop. During this wait period, the ink which was retracted during the refill pulse component is allowed to return to a location adjacent to the orifice outlet 14 prior to the arrival of the drop ejection pressure pulse as a result of pulse component 104. By positioning the meniscus at substantially the same position prior to the drop ejection pressure pulse component, uniformity of drop flight time to the print medium is enhanced over a wide range of drop ejection rates. In addition, the duration of the wait period is preferably established to allow the ink meniscus to advance within orifice 103 to a position substantially at the ink drop ejection orifice outlet 14, but not beyond such orifice outlet, before the ink chamber 22 is contracted to eject a drop of ink. If ink is allowed to project beyond the orifice outlet for a substantial period of time before the eject pulse is applied, it may wet the surface surrounding the orifice outlet. This wetting may cause an asymmetric deflection of ink drops and non-uniform drop formation as the various drops are formed and ejected.

In addition, it is preferable that the ink meniscus have a remnant of forward velocity within the orifice 103 toward outlet 14 at the time of arrival of the pressure pulse in response to the eject pulse component 104 of FIG. 2. Under these conditions, the fluid column propelled out of the ink jet print head properly coalesces into a drop to thereby minimize the formation of satellite drops. The eject pulse component 104 causes the diaphragm 34 of the pressure transducer to rapidly move inwardly toward the ink chamber 22 and results in a sudden pressure wave. This pressure wave ejects the drop of ink presented at the orifice outlet at the end of the wait period. Following the termination of the eject pulse component 104, diaphragm returns toward its original position and, in so doing, initiates a negative pressure wave which assists in breaking off an ink drop.

Exemplary durations of the various pulse components are 5 microseconds for the "A" portion of the or refill pulse component 102, with rise and fall times of respectively 1 microsecond and 3 microseconds; a wait period "B" of 15 microseconds; and an eject pulse component 104 with a "C" portion of 5 microseconds and with rise and fall times like those of the refill pulse component. In general, it is preferable to minimize the duration of these time periods so that the fluidic system may be reinitialized as quickly as possible, making faster printing rates possible. Attempting to eject successive drops before the system is reset may cause considerable changes in the velocity of the drops being ejected.

Figure 4A:
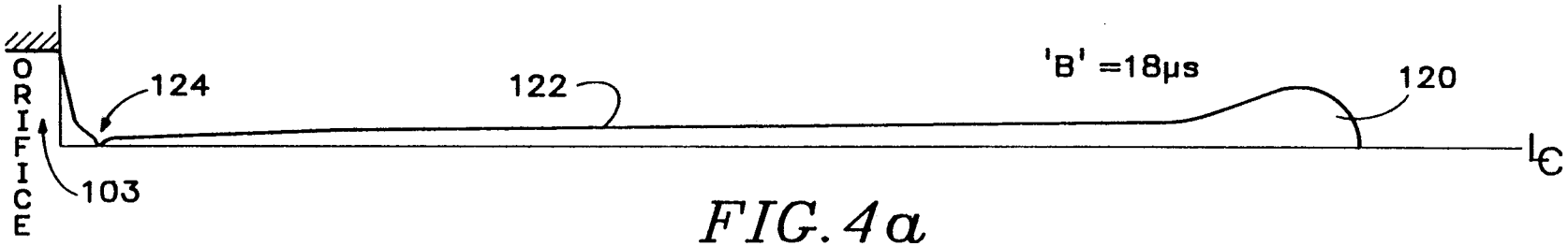
FIGS. 4*a*, 4*b* and 4*c*, illustrates a simulation of the change in shape of an ejected ink column at a point near breakoff of an ink drop from the column when an ink jet print head of the FIG. 3 form is actuated by a single drive pulse of the type shown in FIG. 2 and with the wait period for such pulse being varied.

As shown in FIG. 4*a*, with the duration of the wait period "B" at 18 microseconds, the main volume of ink 120 forming a spherical head which is connected to a long tapering tail 122 with drop breakoff occurring at a location 124 between the tail of this filament and the orifice outlet. After drop breakoff the tail starts to coalesce into the head and does not form a spherical drop by the time it reaches the print medium. However, due to the relatively high speed of the ink column with respect to the print medium the resulting spot on the print medium is nearly spherical.

Figure 4B:
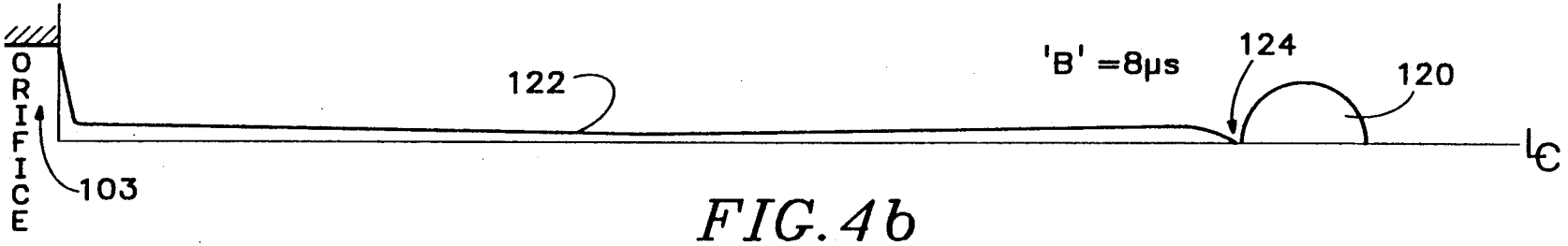

As shown in FIG. 4*b*, with a wait period at 8 microseconds, the drop breakoff point 124 is adjacent to the main volume of ink 120 and results in a cleanly formed drop. In this case, the tail 122 of the drop breaks off subsequently of the orifice outlet 14 and forms a satellite drop which moves towards relatively smaller velocity than the main drop. Consequently, the main drop and satellite drop forms two separate spots on the print medium.

Figure 4C:
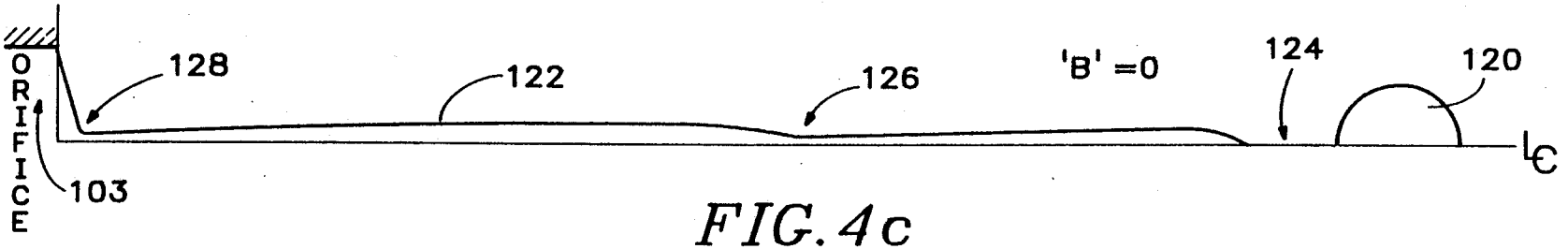

With reference to FIG. 4*c*, and with a wait period at zero microseconds, the drop breakoff point 124 occurs adjacent to the main drop volume 120. However, the remaining ink filament 122 has weak points, indicated at 126 and 128, corresponding to potential locations at which the filament may break off and form satellite drops.

The FIG. 4 illustrations are a result of a theoretioal modelinq of the operation of the ink jet of FIG. 3 using the wave form shown in FIG. 2. The FIG. 4 illustrations show only the upper half of the formed drop above the center line of the orifice 103 in each of these figures.

Neither a pull back or refill pulse, such as pulse component 102 alone, nor an eject pulse, such as component 104 alone, results in satisfactory print performance, even though drop ejection may be accomplished by either of the pulse components 104, 106 alone. In practice, using just a refill pulse component 104 would tend to severely limit the drop ejection speed, such as to about 3.5 meters per seconds or less. In addition, increasing the magnitude or duration of the refill pulse component 104, in an attempt to increase drop speed, would result in pulling the meniscus so far into the upstream edge of the ink orifice 103 that ingestion of air bubbles may result. High drop speeds are desirable, such as on the order of 6 meters per second or more, to increase the capacity of an ink jet printer to operate at high drop ejection rates.

Figure 6:
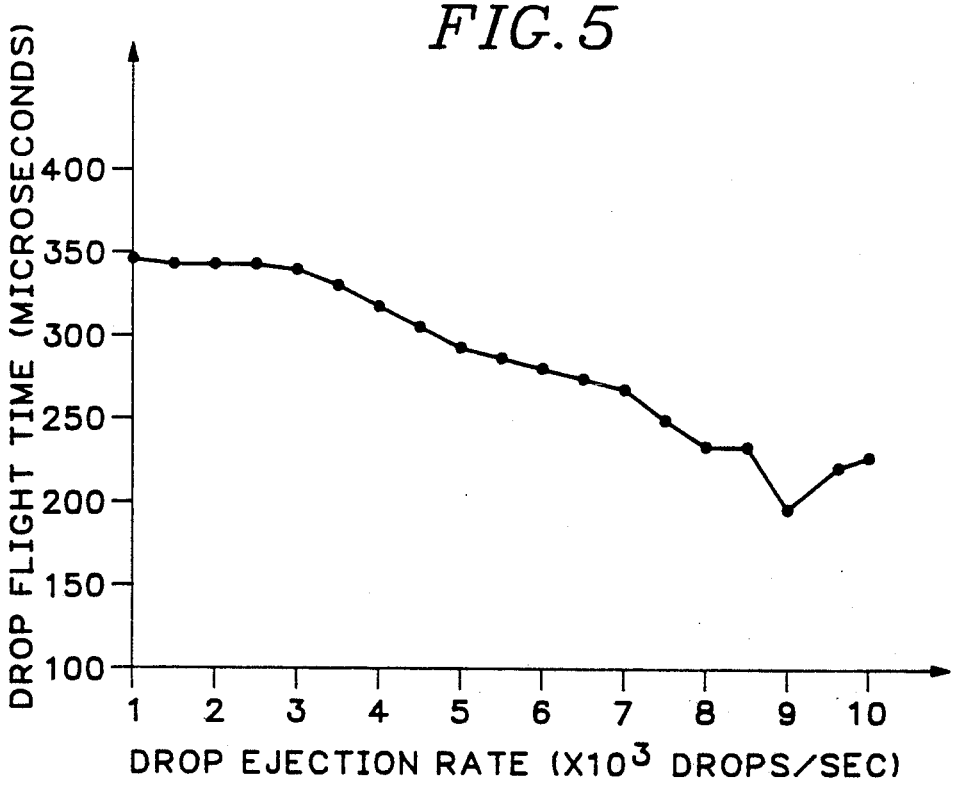
FIG. 6 is a plot of the drop flight time as a function of drop ejection rate for the continuous operation of an ink jet of the type illustrated in FIG. 3 actuated by a drive pulse having only the eject pulse component "C" of the wave form of FIG. 2 and in which the eject pulse has been optimized for a specific ink jet print head.

The use of an eject pulse component 104 only, without the refill pulse and wait period components, results in a rhythmical variation in drop speed with changing drop ejection rates. The frequency of the rhythmical variations may be verified from the information in Table 1 to be the same as that of the reverberation resonance in the channel sections forming the ink flow path between the ink chamber 22 and the ink orifice outlet 14. As shown in FIG. 6, an eject pulse component only drive signal may be designed which smoothes the speed or flight time variations by using a drive pulse with a frequency spectrum which deliberately removes energy from the reverberations. However, in this case, the ink volume per drop declines as the ejection rate increases. In other words, the ink chamber does not adequately refill between drop ejections at all drop ejection rates. A further disadvantage is that, since the same amount of energy is imparted by the piezoelectric element to every drop ejected regardless of refilling, the smaller drops tend to travel at faster speeds. Thus, as shown in FIG. 6, the drop speed generally increases (corresponding to a decrease in flight drop time) as the drop ejection rate increases, although the rhythmical drop speed variations are absent.

The deficiencies of the eject only pulse component drive approach, are overcome by actuating a refill pulse component 104 first to actively refill the ink chamber 22. In addition, the offset channel 71 in FIG. 3 is also refilled if the ink jet print head is of a design having such a channel. The ink chamber may be passively refilled fully by enlarging the ink inlet 18, 20 from the ink supply reservoir (11 in FIG. 1), without using an active refill pulse component 104. However, in this case upon movement of the diaphragm inwardly to cause a drop to issue from the drop ejection orifice 14, the pressure pulse set up in the ink chamber 22 would flow into the conduit leading to the orifice 26 and also into the ink inlet 18, 20 itself. The portion of the pressure wave traveling into the ink inlet would then represent energy unavailable for the ink drop formation. The use of an active refill pulse component permits a smaller inlet opening 20 which reduces this potential loss of energy available for drop formation and also isolates the body chamber 22 and passageway 26 from pressure pulse disturbances originating in the ink reservoir or manifold 16 if the jet is a member of an array. This isolation is progressively reduced as the inlet opening 20 is enlarged. A balance is thus struck among the size of the ink inlet 20, the strength of the refill pulse component 102 (FIG. 2) and the strength of the eject pulse component 104. A strong refill pulse component 102 will pull ink through the inlet opening 20 into the pressure chamber 22. Too strong of a refill pulse component will cause the ingestion of a bubble through the orifice outlet. Likewise, too strong of an eject pulse component 104 will eject more ink in a single drop than the refill pulse component may be able to draw through the ink inlet 20. One preferred interrelationship of these parameters is described in Table 1 and in the exemplary pulse component durations mentioned above.

It should also be noted that the inclusion of a refill pulse component in the drive signal tends to swallow ink back from the external surface surrounding the ink orifice outlet 14. This action minimizes the possibility of ink wetting the surface surrounding the outlet and distorting the travel or breakoff of ink drops at the orifice outlet.

It should also be noted that the preferred duration of the wait period "B" is a combined function of the time for the retracted meniscus in orifice 103 to reach the orifice outlet 14 and the velocity of the ink at the instant of arrival of the positive pressure pulse initiated by the eject pulse component 104. It is desired that the retracted meniscus reach the orifice outlet 14 with waning velocity just before the pressure pulse from the pulse component is applied.

Figure 5:
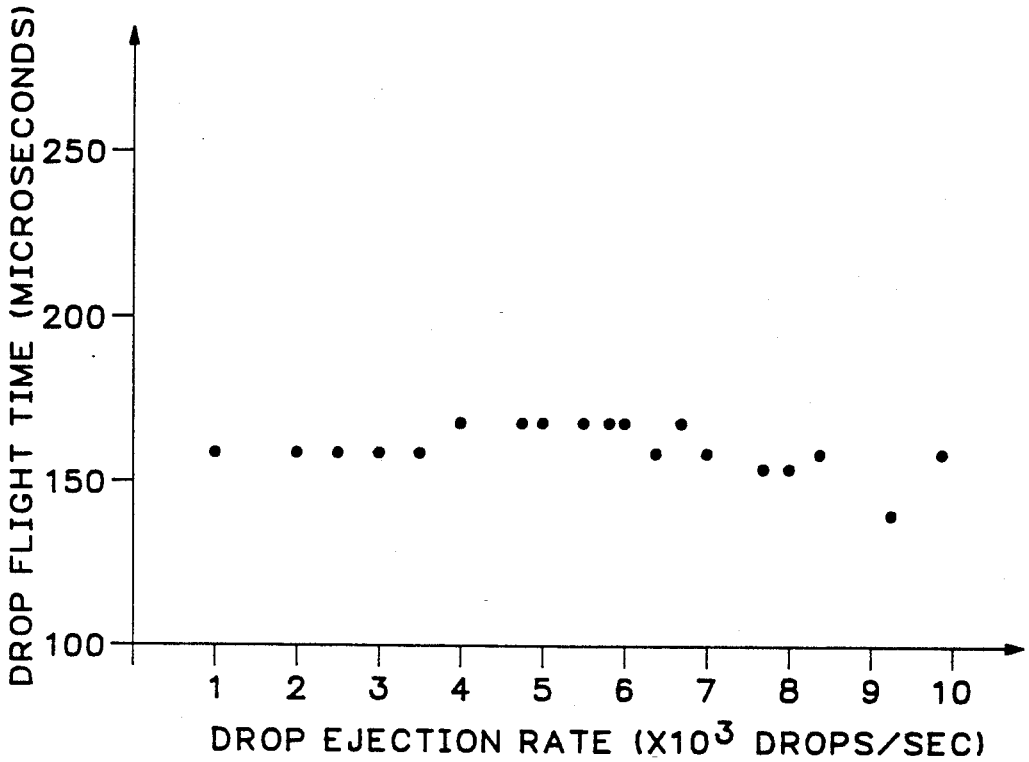
FIG. 5 is a plot of drop flight time versus drop ejection rate for the continuous operation of an ink jet print head of the type illustrated in FIG. 3 when actuated by the drive wave form of FIG. 2, where the eject pulse width has been optimized.

As shown in FIG. 5, and which should be contrasted with FIG. 6, a plot of the flight time for an ink jet print head of the type shown in FIG. 3 versus drop ejection rate is substantially constant over a range of drop ejection rates through and including ten thousand drops per second. In this FIG. 5 example, the print medium was 0.04 inch from the ink jet orifice outlet 14 and drop speeds in excess of 6 meters per seconds have been achieved. As also shown in FIG. 5, a maximum deviation of 30 microseconds was observed over an ink jet drop ejection rate ranging from 1,000 drops per second to 10,000 drops per second. In addition, at below 8,500 drops per second, this deviation was much less pronounced. Thus, by suitably selecting a drive wave form having a refill pulse component 102, a wait period 106 and an eject pulse component 104, substantially constant drop flight times can be achieved over a wide range of drop ejection rates. In addition, the drop speeds are relatively fast with uniform drop sizes being achievable. In addition, drop trajectories are substantially perpendicular to the orifice face plate for all drop ejection rates inasmuch as the refill pulse component of the drive pulse assists in preventing wetting of the external surface surrounding the orifice outlets 14 which may cause a deflection of the ejected drops from a desired trajectory. Moreover, satellite drop formation is minimized because this drive wave form allows high viscosity ink, such as hot melt ink, within the conduit of the orifice 103 to behave as an intracavity acoustic absorber of pressure pulses reverberating in the offset channel 71 of an ink jet of the type shown in FIG. 3. Moreover, the relatively simple drive wave form of FIG. 2 may be achieved with conventional off-the-shelf digital electronic drive signal sources.

Referring again to FIG. 2, a preferred relationship between the drive pulse components 102, 104 and 106 have been experimentally determined. In particular, for an ink jet print head, such as of the type shown in FIG. 3, by establishing a wait time period of at least about and preferably greater than about 8 microseconds, uniform and consistent ink drop formation has been achieved. Shorter wait periods have been observed in some cases to increase the probability of formation of satellite drops than with the wait period established at or above this 8 microsecond level. In addition, preferably the refill or expanding pulse component 102 is no more than about 16 to 20 microseconds. A greater refill pulse component duration increases the possibility of ingesting bubbles into the ink orifice outlet. In addition, the refill pulse component duration need be no longer than necessary to replace the ink ejected during ink drop formation. In general, shorter refill periods increase the drop repetition rate which may be achieved. In general, the refill pulse component 102 has a duration in a preferred form of no less than about 7 microseconds. In addition, the duration of the ejection pulse component 104 is typically no more than about 16 to 20 microseconds and no less than about 6 microseconds. Again, pulse components within these ranges enhances the uniformity of drop formation and drop travel speed over a wide variation in drop ejection rates.

Within these drive wave form parameters, ink jets of the type shown in FIG. 3 have been operated at drop ejection rates through and including 10,000 drops per second, and higher, and at drop ejection speeds in excess of 6 meters per second. The drop speed nonuniformity has been observed at less than 15 percent over continuous and intermittent drop ejection conditions. As a result, the drop position error is much less than one-third of a pixel at 300 dpi printing with 8 KHz maximum print rate. In addition, a measured drop volume of 170 pl of ink per drop +/− 15 pl (over the entire operating range of 1,000 to 10,000 drops per second) has been observed and is suitable for printing at 300 dots per inch addressability when using hot melt inks. Additionally, minimal or no satellite droplets occur under these conditions.

As shown in FIG. 2, the first electric drive pulse component 102 reaches a maximum amplitude and is maintained at this maximum amplitude for a period of time prior to termination of the first electric drive or refill pulse component. In addition, the second electric drive or eject pulse component 104 also rises to a maximum amplitude and is maintained at this maximum amplitude for a period of time prior to termination of the second electric drive pulse. Although this may be varied, in the illustrated form, these drive pulse components are trapezoidal in shape and have a different rate of rise time to their maximum amplitude from the rate of fall time from their maximum amplitude. In a preferred wave form, the two pulse components 102, 104 have rise times from about 1 microsecond to about 4 microseconds, have a maximum amplitude of from about 2 microseconds to about 7 microseconds and have a fall time of from about 1 microsecond to about 7 microseconds, with the wait period being greater than about 8 microseconds. In a most preferred wave form, the rise time of the first electric drive pulse is from about 1 to about 2 microseconds, the first electric drive pulse is at a maximum amplitude for from about 3 microseconds to about 7 microseconds and the first electric drive pulse has a fall time of from about 2 microseconds to about 4 microseconds and the wait period is from about 15 microseconds to about 22 microseconds. In addition, in this case the eject pulse component 104 is like the refill pulse component 102.

It should be noted that these durations may be varied for different ink jet print head designs and different ink jet ink. Again, it is desirable for the meniscus to be traveling forward and to be at a common location at the occurrence of each pressure wave resulting from the application of the eject pulse component 104. The parameters of the drive wave form may be varied to achieve these conditions.

It has also been discovered that optimal performance is achieved when the drive pulse is shaped so as to provide a minimum energy content at the dominant acoustic resonance frequency of the ink jet print head. That is, the dominant acoustic resonance frequency of the ink jet can be determined in a well known manner and in general depends upon the length of the ink flow path 26 from the ink chamber 22 to the orifice outlet 14. When an ink jet of the type shown in FIG. 3 is used with an offset channel 71, the dominant acoustic resonance frequency in general corresponds to the standing wave resonance frequency through the liquid ink in the offset channel. By using a drive pulse with an energy content which is at a minimum at the dominant acoustic resonance frequency of the ink jet, reverberations at this dominant acoustic resonance frequency are minimized, such reverberations otherwise potentially interfering with the uniformity of flight time of drops from the ink jet to the print medium.

In general, in accordance with one aspect of the method of the present invention, a fourier transform or spectral analysis is performed of the complete drive pulse. The complete drive pulse is the entire pulse used in the drop formation. In the case of a drive pulse consisting of a single pulse of the type shown in FIG. 2, the complete pulse includes the refill pulse component 102, the wait period component 106 and the eject pulse component 104. A conventional spectrum analyzer may be used in determining the energy content of the drive pulse at various frequencies. This energy content will vary with frequency from highs or peaks to valleys or low points. A minimum energy content portion of the wave form at certain frequencies is substantially less than the peak energy content at other frequencies. For example, a minimum energy content may be at least about 20 db below the maximum energy content of the drive pulse at other frequencies.

The drive pulse may be adjusted to shift the frequency of this minimum energy content to correspond substantially with, that is to be substantially equal to, the dominant acoustic resonance frequency. With the drive signal adjusted in this manner, the energy of the drive pulse at the dominant acoustic resonance frequency is minimized. As a result, the effect of resonance frequencies of the ink jet print head on ink drop formation is minimized. Although not limited to any specific approach, a preferred method of adjusting the drive pulse comprises the step of adjusting the duration of the first drive pulse, or refill pulse component 102 and of the wait period 106. These pulse components are adjusted in duration until there is a minimum energy content of the drive pulse at the frequency which is substantially equal to the dominant acoustic resonance frequency.

Finally, it should be noted that the present invention is applicable to ink jet printers using a wide variety of inks. Inks that are liquid at room temperature, as well as inks of the phase change type which are solid at room temperature, may be used. One suitable phase change ink is disclosed in U.S. patent application Ser. No. 227,846, filed Aug. 3, 1988 and entitled "Phase Change Ink Carrier Composition and Phase Ink Produced Therefrom" now U.S. Pat. No. 4,889,560. Again, however, the present invention is not limited to particular types of ink.

Having illustrated and described the principles of our invention with reference to several preferred embodiments, it will be apparent to those of ordinary skill in the art that the invention may be modified in an arrangement in detail without departing from such principles. We claim as our invention all such modifications which fall within the scope of the following claims.

We claim:

1. A method of operating an ink jet of the type having an ink chamber coupled to a source of ink and coupled to an ink drop ejecting orifice, and acoustic driver means for expanding a volume of the ink chamber when subjected to an electric drive pulse of a first relative polarity and for contracting the volume of the ink chamber when subjected to an electric drive pulse of a second relative polarity, the ink jet having a dominant acoustic resonant frequency, the method comprising:

applying a first electric drive pulse of the first relative polarity to the acoustic driver means to expand the ink chamber;

terminating the first electric drive pulse and allowing the acoustic driver means to remain in a substantially undriven state for a wait period; and applying a second electric drive pulse of the second relative polarity to the acoustic driver means following the wait period to contract the ink chamber and eject a drop of ink from the ink drop ejection orifice outlet toward a print medium, the drop of ink striking the print medium after a drop flight time, and the first electric drive pulse, the wait period, and the second electric drive pulse being components of a complete drive pulse having a minimum energy content at a substantially the dominant acoustic resonant frequency of the ink jet, the complete drive pulse being a component of a periodic drive signal in which ones of the complete drive pulses are applied at varying repetition rates, and whereby ink drops are ejected over a range of drop ejection rates in response to the varying repetition rates of the complete drive pulses, with the drop flight times being substantially constant over the range of drop ejection rates.

2. A method according to claim 1 in which the ink drop ejecting orifice includes an ink drop ejection orifice outlet, and the ink jet is of a type having an offset channel between the ink chamber and the ink drop ejection orifice outlet, the dominant acoustic resonant frequency corresponding to a standing wave resonant frequency through ink in the offset channel of the ink jet.

3. A method according to claim 1 in which the ink drop ejecting orifice includes an ink drop ejection orifice outlet, and the wait period is of a sufficient duration to allow the ink in the orifice to move forward toward the orifice outlet to a predetermined position prior to the application of the second electric drive pulse.

4. The method of claim 1 in which the first electric drive pulse has sufficient energy to cause ejection of the drop of ink through the ink drop ejecting orifice.

5. The method of claim 1 in which the range of drop ejection rates includes 8,000 drops per second.

6. An ink jet having a dominant acoustic resonant frequency, comprising:

an ink chamber coupled to a source of ink and an ink drop ejecting orifice, the ink chamber having a variable volume;

signal source means for producing a periodic drive signal comprising complete drive pulses with constant periods applied at varying repetition rates, each complete drive pulse comprising a first electric drive pulse having a first relative polarity, a wait time period, and a second electric drive pulse having a second relative polarity, and each complete drive pulse having a minimum energy content at substantially the dominant acoustic resonant frequency of the ink jet; and acoustic driver means receiving the periodic signal for causing ejection of ink drops from the ink drop ejecting orifice toward a print medium over a range of drop ejection rates in response to the repetition rates of the complete drive pulses, the ink drops striking the print medium after drop flight times which are substantially constant over the range of drop ejection rates.

7. The ink jet of claim 6 in which a duration of one of the complete drive pulses in less than about 40 microseconds.

8. The ink jet of claim 6 in which the first electric drive pulse has sufficient energy to cause ejection of the ink drop through the ink drop ejecting orifice.

9. The ink jet of claim 6 in which the range of drop ejection rates includes 8,000 drops per second.

10. An ink jet having a dominant acoustic resonant frequency, comprising:

an ink chamber coupled to a source of ink and coupled to an ink drop ejecting orifice, the ink chamber having a variable volume;

signal source means for producing a periodic drive signal comprising complete drive pulses applied at varying repetition rates, the complete drive pulses each comprising a first electric drive pulse having a first relative polarity, a wait time period, and a second electric drive pulse having a second relative polarity, and each complete drive pulse having a minimum energy content at substantially the dominant acoustic resonant frequency of the ink jet; and acoustic driver means receiving the complete drive pulses for expanding the volume of the ink chamber when the driver means receives one of the first electric drive pulses and contracting the volume of the ink chamber when the driver means receives one of the second electric drive pulses, thereby causing ejection of ink drops from the ink drop ejecting orifice toward a print medium over a range of drop ejection rates in response to the repetition rates of the complete drive pulses, the ink drops striking the print medium after a drop flight time which is substantially constant over the range of drop ejection rates.

11. The ink jet of claim 10 in which a duration of one of the complete drive pulses is less than about 40 microseconds.

* * * * *

UNITED STATES PATENT AND TRADEMARK OFFICE

CERTIFICATE OF CORRECTION

PATENT NO. : 5,170,177

DATED : December 8, 1992

INVENTOR(S) : Douglas M. Stanley et al.

It is certified that error appears in the above-identified patent and that said Letters Patent is hereby corrected as shown below:

Claim 1, col. 14, line 13, delete "a".

Claim 7, col. 14, line 67, "in" should be "is".

Signed and Sealed this

Twenty-third Day of November, 1993

*Attest:*

Bruce Lehman

BRUCE LEHMAN

*Attesting Officer*

*Commissioner of Patents and Trademarks*